US006016761A

United States Patent [19]

Berg, Sr.

[11] Patent Number: 6,016,761

[45] Date of Patent: Jan. 25, 2000

[54] LIFT-OFF COVER ASSEMBLY FOR A BARGE

[75] Inventor: Robin L. Berg, Sr., Hudson, Wis.

[73] Assignee: Proform Company LLC, Minneapolis, Minn.

[21] Appl. No.: 08/907,417

[22] Filed: Aug. 7, 1997

[51] Int. Cl.[7] ..... B63B 19/12

[52] U.S. Cl. ..... 114/201 R

[58] Field of Search ..... 114/26, 201 R–203

[56] References Cited

U.S. PATENT DOCUMENTS

| | | | |
|---|---|---|---|
| 932,414 | 8/1909 | Remington | 114/201 R |
| 2,156,635 | 5/1939 | Mascuch et al. | 114/201 |
| 3,800,723 | 4/1974 | Collins | 114/26 |
| 4,461,232 | 7/1984 | Berg . | |

*Primary Examiner*—Ed Swinehart
*Attorney, Agent, or Firm*—Long Aldridge & Norman LLP; Steven B. Kelber

[57] ABSTRACT

A lift-off cover assembly for barges includes adjacently positioned curved cover sections and end cover sections located at opposite ends of the adjacently positioned curved cover sections. The cover assembly includes a central walkway which extends between openings on the cover assembly and climbing stairs which are positioned so as to facilitate the travel of a cargo loading operated toward the openings. Additionally, each of openings can include cover members such as lids or doors which have handles or latches that are accessible from the central walkway.

14 Claims, 5 Drawing Sheets

FIG. 8
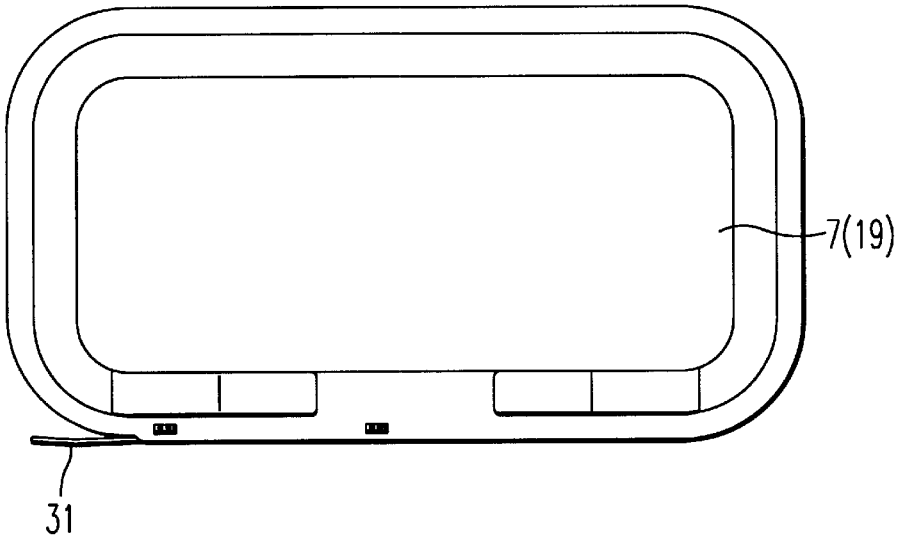
FIG. 9
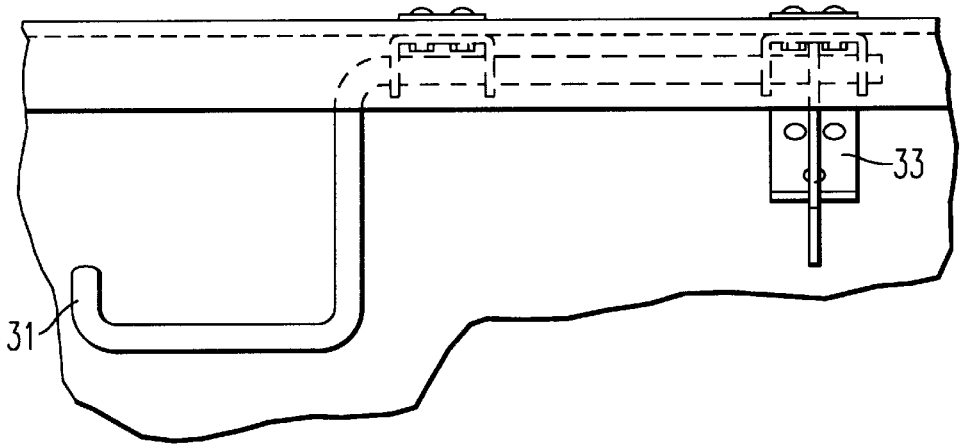
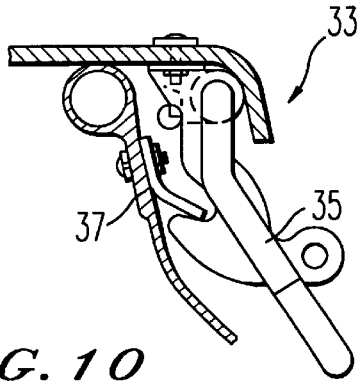
FIG. 10

LIFT-OFF COVER ASSEMBLY FOR A BARGE

BACKGROUND OF THE INVENTION

1. Field of the Invention

The present invention relates to a lift-off cover assembly for ship barges or the like which includes a plurality of adjacently positioned curved sections and end sections. The cover assembly can be made of a semirigid to rigid lightweight material such as fiberglass reinforced resin and is adapted to be placed on the barge so as to define a storage space thereunder.

2. Discussion of the Background

Related barge covers, such as those manufactured by Proform Corp., Syntechnics, Xenium and others, do not provide the necessary storage space that has recently been desired. Also, these related barge covers do not include adequate provisions for the safety of cargo loading operators who walk on the barge covers.

Additionally, these related barge covers have openings which are not sufficiently wide to permit the adequate loading of cargo and furthermore, include doors on the openings which require that a cargo loading operator walk to the center of the door, unlatch the door, lift the door into position, and then throw the door open by thrusting against the front edge. This procedure requires that the cargo loading operator stand on the slanted portion of the barge cover and leaves the cargo loading operator leaning into the opening and looking down about 18 feet into the barge hopper floor. Also, these doors tended to be randomly placed at varying heights.

Also, the opening action of the doors in these related barge covers causes damage to the doors and the hinges when the doors abut against the top of the barge cover upon opening. That is, the doors on these related barge covers tend to impact along the center and middle of the door upon opening which causes the door to twist and thereby damage the hinges. Therefore, these doors and hinges require replacement upon use.

Also, in these related barge covers, the stairs, center walkway and rib end walkways do not have a sufficient width to permit a cargo loading operator to safely walk along the barge cover and are of varying height and different placements.

SUMMARY OF THE INVENTION

Accordingly, an object of this invention is to provide for a lift-off cover assembly for barges which overcomes the above-mentioned drawbacks and includes the following features.

The cover assembly of the present invention provides more volume for cargo since the inventive cover assembly has an increased height when compared to the related barge covers.

Additionally, the placement of the doors, lids, cover or closing members of the end cover assembly of the present invention is closer to the end of the cover assembly in a lengthwise direction and the door openings are wider than related barge covers.

Also, the doors or lids of the barge cover assembly of the present invention have a wider opening frame, do not include indents, have a radius which for the most part are larger than the radius of existing barge cover doors, and are lighter than the doors of related barge covers.

Also, the doors and stairs of the barge cover assembly of the present invention are consistently placed so that cargo loading operators are always aware of their location.

The doors or lids of the barge cover assembly of the present invention which are lighter in weight and can include a novel handle assembly which permits the doors to be opened with one hand as a cargo loading operator walks down the center walkway of the barge cover assembly.

The doors or lids of the barge cover assembly of the present invention also include raised portions or a cradles with integral bumpers which are integral with the door and increase the life span of the door. This is because the raised portions are positioned on the doors at a location which will cause the raised portions to abut against raised ribs on the barge cover assembly upon the opening of the door; and because the raised portions on the doors of the present invention are at the far edges of the door and opposite to the hinges rather than in the middle of the door. This reduces a force by half upon the opening of the door and eliminates any twisting when the door is opened due to the fact that the raised portions hit opposite the hinges in a balanced manner.

Additionally, the barge cover assembly of the present invention includes climbing stairs which are of a consistent run and rise. Also, pathways and the climbing stairs of the barge cover assembly of the present invention include non-skid areas which are larger than those of related barge covers.

Furthermore, the barge cover assembly of the present invention includes raised spaced ribs which define spaces that extend to the edges of the barge cover assembly and form open spaces at the edges. The spaces between the raised ribs define an effective area for drainage of water to the edges of the barge cover assembly. Additionally, since the spaces are wider, it is easier for the cargo loading operator to walk within the spaces to different areas on the barge cover assembly safely and easily.

The present invention therefore provides for a cover assembly for a barge which comprises at least one curved cover section having a width which extends over a width of a barge; a first opening located on a first side of a central longitudinal axis of the at least one curved cover section; a second opening located on a second side of the central longitudinal axis of the at least one curved cover section; a first cover member for closing the first opening; and a second cover member for closing the second opening.

The present invention further provides for a cover assembly for a barge which comprises a plurality of adjacently positioned curved cover sections; first and second end cover sections positioned on opposite ends of the adjacently positioned curved cover sections to define, with said plurality of adjacently positioned curved cover sections, a cover assembly which is adapted to fit on a barge so as to define a storage space thereunder; a plurality of openings positioned on each side of a central longitudinal axis which extends along the adjacently positioned curved cover sections and the first and second end cover sections; lids associated with each of the openings which cover each of the openings in a closed position of the lids; and a central path extending along the central longitudinal axis.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 8 is a top view of the door and handle member;

FIG. 9 illustrates an example of a locking assembly which can be used with the door of the barge cover assembly of the present invention; and FIG. 10 is a further view of the locking assembly of FIG. 9 which can be used with the door of the barge cover assembly of the present invention.

DESCRIPTION OF THE PREFERRED EMBODIMENTS

Figure 1:
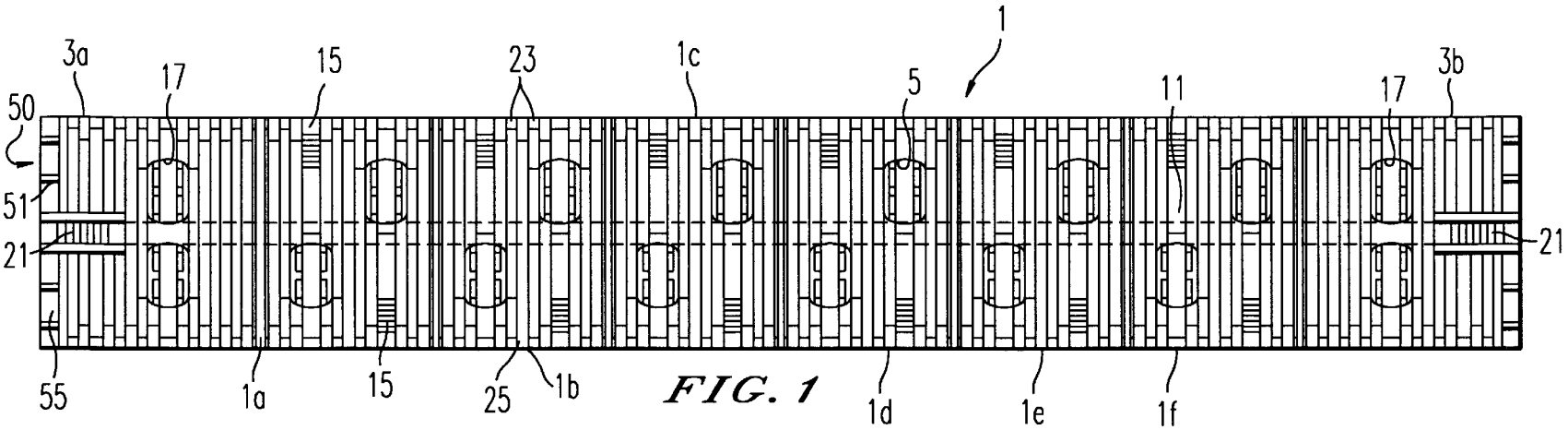
FIG. 1 is a top view of the barge cover assembly of the present invention.

Referring now to the drawings, wherein like reference numerals designate identical or corresponding parts throughout the several views, FIG. 1 illustrates a top view of a lift-off barge cover assembly 1 of the present invention. The barge cover assembly 1 can include a plurality of curved (arcuate) cover sections 1*a*–1*f* as illustrated in FIG. 1. Although the embodiment of FIG. 1 shows six curved cover sections 1*a*–1*f*, it is recognized that the number of curved cover sections depends on the size of the barge to be covered. Each of the curved cover sections 1*a*–1*f* can be sealed, welded, locked, fitted, etc., to each other at their boundaries to provide for the barge cover assembly 1. On opposite ends of the curved cover sections 1*a*–1*f*, as illustrated in FIG. 1, the barge cover assembly 1 includes curved end cover sections 3*a*, 3*b*. The curved end cover sections 3*a*, 3*b* can be fitted, welded, sealed, locked, etc. to the ends of the curved cover sections 1*a*–1*f* at their boundaries. The curved cover sections 1*a*–1*f* and end cover sections 3*a*, 3*b* can be made of a semirigid to rigid material such as, for example, fiberglass reinforced resin.

Figure 2:
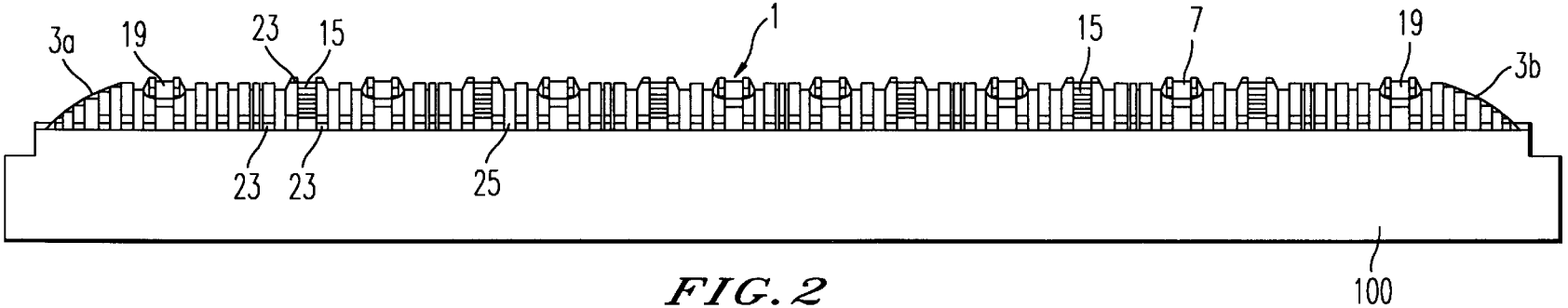
FIG. 2 is a side view of the barge cover assembly of FIG. 1 showing the barge cover assembly positioned on a barge.
Figure 3:
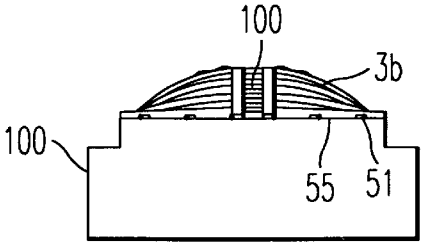
FIG. 3 is an end view showing the end cover section of the barge cover assembly.

As illustrated in FIG. 2, the barge cover assembly 1 can be positioned on a barge 100 and defines a curvature which permits an increased storage of cargo below the barge cover assembly 1. In view of the curvature of the cover assembly 1, the present invention provides for a novel and consistent positioning of openings, doors, stairs and pathways which facilitate the travel of cargo loading operators on the barge cover assembly 1 and also facilitates the loading and observation of cargo.

Figure 4:
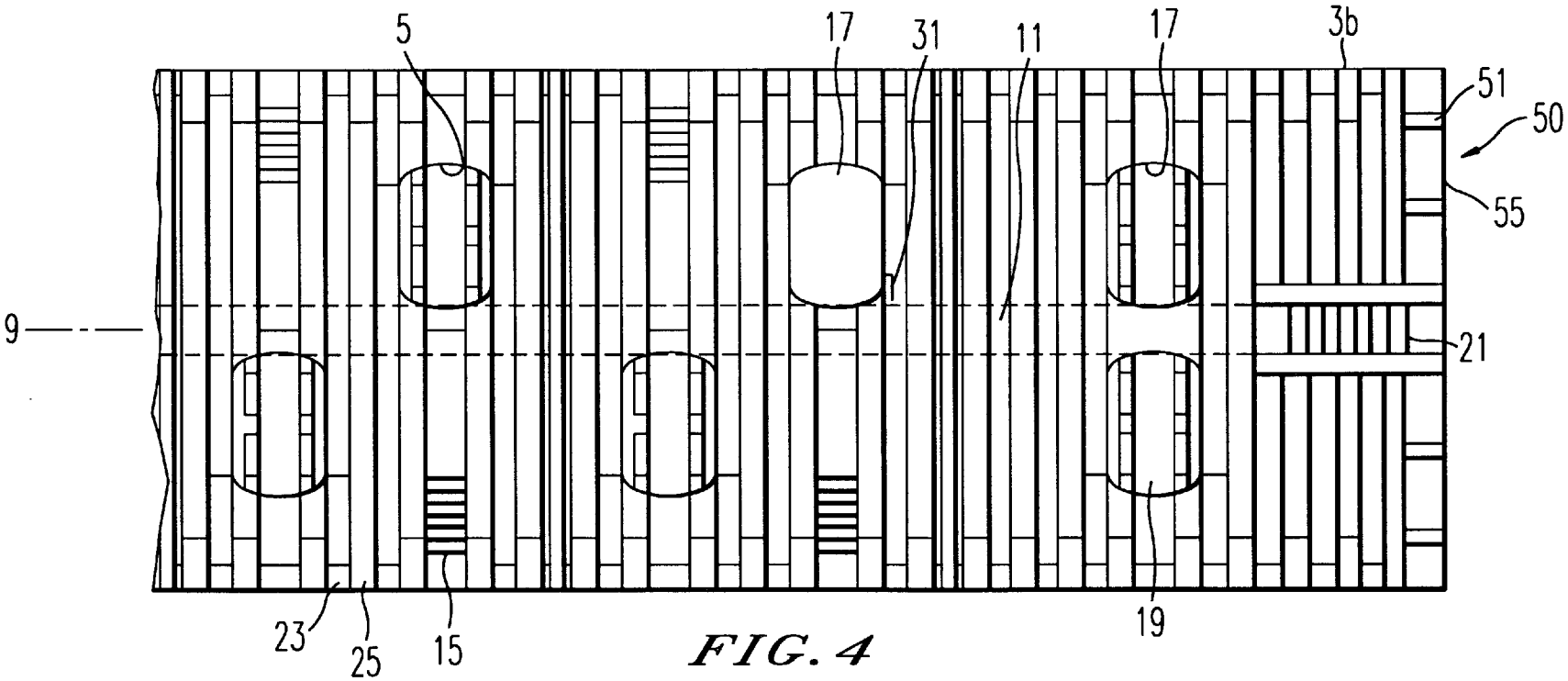
FIG. 4 is a view showing selected cover sections of the barge cover assembly.

As illustrated in FIGS. 1–5, each of the curved cover sections 1*a*–1*f* includes an opening 5 which can be closed by a cover member 7 such as a door or lid which can be hinged at the openings 5. The openings 5 for each of the curved cover sections 1*a*–1*f* can be positioned on each side of a longitudinal axis 9 of the cover assembly 1 as illustrated in FIGS. 1 and 4.

The cover assembly 1 of the present invention also includes a central walkway 11 illustrated in FIGS. 1 and 4. The central walkway 11 extends along the longitudinal axis 9 and between each of the openings 5 and doors 7.

The barge cover assembly 1 of the present invention further includes climbing stairs 15 associated with each of the openings 5 in the curved cover sections 1*a*–1*f*. The climbing stairs 15 for each of the curved cover sections 1*a*–1*f*, as illustrated in FIG. 4, extend in a direction substantially perpendicular to the longitudinal axis 9, from an edge of one side of an associated curved cover section 1*a*–1*f* toward a vicinity of an opening 5. Each of the climbing stairs 15 and its associated opening 5 to which the climbing stair 15 extends to is located within the same vertical plane as illustrated in FIGS. 1 and 4.

Figure 5:
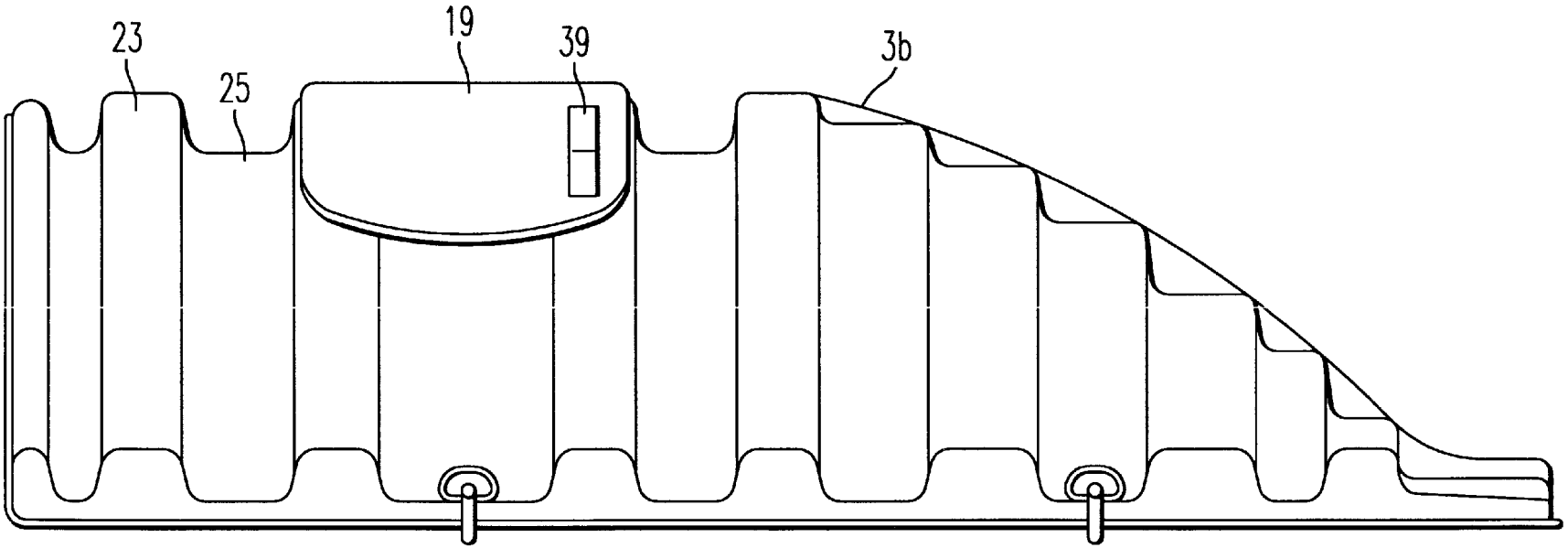
FIG. 5 is a view showing the end cover section of the barge cover assembly.

The end cover sections 3*a*, 3*b* include openings 17 having a door 19 (FIG. 5).

Each of the openings 17 is positioned on opposite sides of the longitudinal axis 9 of the cover assembly 1. Each of the end cover sections 3*a*, 3*b* further includes climbing stairs 21 (FIGS. 1 and 3) which extend along a direction of the longitudinal axis 9 and lead to an area between the openings 17 as illustrated in FIGS. 1 and 4. Each of the openings 5, 17 are positioned in the vicinity of the edges of the barge cover assembly and the doors 7 and 19 have an increased curvature which increases cargo space.

Each of the curved cover sections 1*a*–1*f* of the barge cover assembly 1 further includes ribs 23 such that spaces 25, of increased width compared to the related barge covers, are defined between each of the ribs 23. The increased width of the spaces 25 makes it easier for the cargo loading operator to walk within the spaces 25. The ribs 23 and spaces 25 extend in a direction substantially perpendicular to the longitudinal axis 9. Selected ones of the spaces 25 include the climbing stairs 15 as illustrated in FIG. 2. The ribs 23 and spaces 25 extend to the edges of the cover assembly so as to define a ribbed edge all along the outer part of the barge cover assembly 1. With this arrangement, any rainwater will flow downward along the sides of the barge cover assembly 1 and over the edges of the barge cover assembly.

Accordingly, when the barge cover assembly 1 of the present invention is mounted on the barge 100 (FIG. 2), a cargo loading operator can climb to the top of the cover assembly 1 via the stairs 15 or 21 to the central walkway 11. It is preferred that the stairs 21 of the end cover sections 3*a*, 3*b* be used to get on the barge cover assembly. Once at the central walkway 11, the cargo loading operator can walk along the central walkway 11 to a desired opening 5 on the curved cover sections 1*a*–1*f*, or 17 on the end cover sections 3*a*, 3*b*. Each of the stairs 15 and 21 are of a consistent run and rise. The stairs 15, 21, as well as the central walkway 11 also can include non-skid surfaces which can cover the whole area of the walkways. Also, the stairs 15, 21, central walkway 11 and walkways defined by the spaces 25 between the ribs 23 are wider so as to facilitate travel along the cover assembly 1. A cargo loading operator can also walk along the edge of the barge cover assembly to a desired space 25 and travel along the space 25 to a particular opening. Also, the side stairs 15 can be utilized in stacking the curved cover sections 1*a*–1*f* on top of one another.

Each of the end cover sections 3*a*, 3*b* also include the above-mentioned ribs 23 and spaces 25 between the ribs 23 (FIG. 5). The spaces and ribs 25, 23 extend toward the edge of the cover assembly 1 so as to define openings and ribbed edges as illustrated in FIG. 5. This is equivalent to the ribbed edges along the curved sections 1*a*–1*f* formed by the ribs 23 and spaces 25 of the curved cover sections 1*a*–1*f*.

As described above, with the provision of the ribs 23 and spaces 25 along the length of the curved cover sections 1*a*–1*f* and end cover sections 3*a*–3*b*, rainwater will drain toward the side of the cover assembly 1 and flow out along the edges which define ribbed edge sections and openings having bigger angles. Therefore, under normal circumstances there would be no possibility of puddles forming along the edges of the cover assembly 1 of the present invention.

Each of the curved end cover sections 3*a*, 3*b* further include ribbed ends 50 having ribs 51 which extend in a direction of the longitudinal axis 9 (FIG. 4). The ribbed ends 50 as illustrated in FIG. 4 define open spaces 55 which permits water to drain from each of the curved end cover sections 3*a*, 3*b*.

Figure 6:
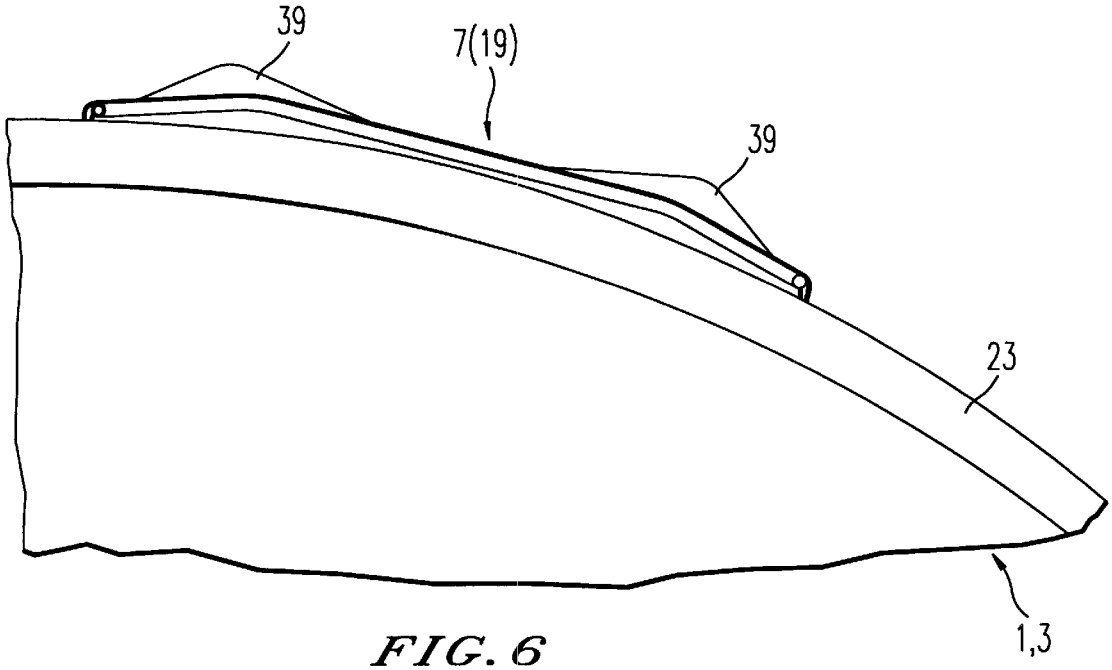
FIG. 6 is a view of the door of the barge cover assembly in a closed positioned.
Figure 7:
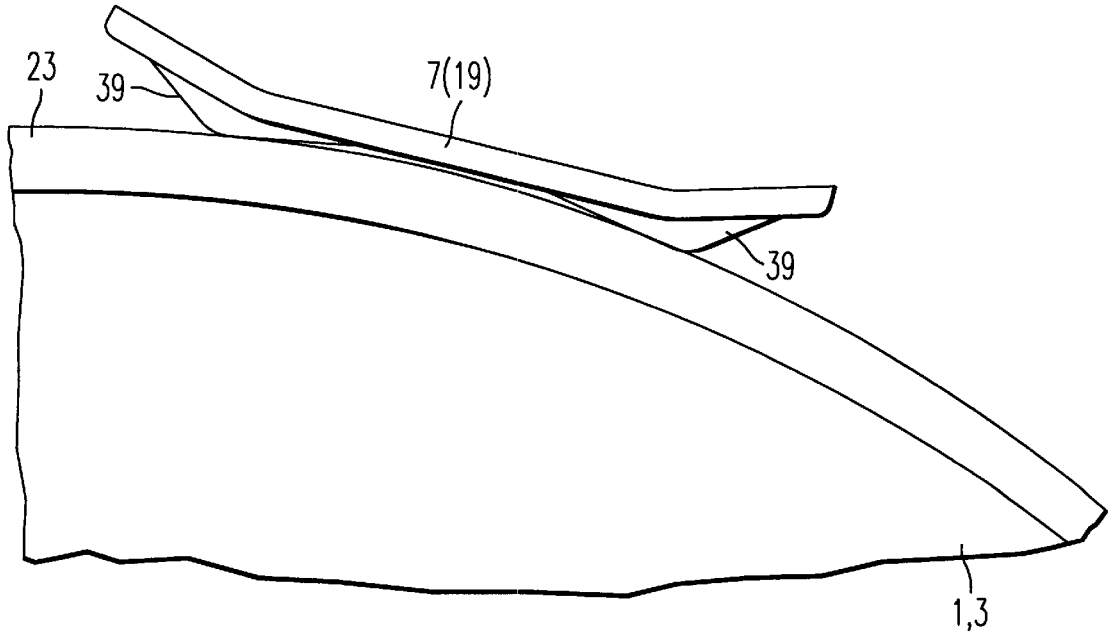
FIG. 7 is a view of the door of the barge cover assembly in an opened position.

Regarding the doors, lids or cover members 7 and 19 of the present invention, each of the doors 7 and 19 are positioned toward an edge of the cover assembly and as illustrated in FIGS. 5–7, include a radius of curvature which permits an increase in the volume under the cover assembly 1. The doors 19 of the end cover sections 3*a*, 3*b* are close to the lengthwise edge of the barge cover assembly. This increases the angle and shortens the distance of the end cover sections 3*a*, 3*b*, so as to prevent draining water from puddling up or freezing along the edges.

Additionally, each of the doors 7 and 19 can include a handle 31 which extends toward the central longitudinal axis 9 and the central walkway 11 of the cover assembly 1 of the present invention. The handle 31 is thus extended so as to be accessible from the central walkway 11. Therefore, the doors 7 and 19 which can be hinged at the respective opening 5, 17 can be easily opened from the center walkway 11. The doors of the related barge covers are generally opened at the center of the door. This can be dangerous since it requires that the cargo loading operator walk toward the center of the door which is generally on the sloped surface of the related barge cover assembly. Additionally, if the cargo loading operator opens the door at the center, upon the opening of the door, the cargo loading operator will be positioned precariously over the opening.

With the specific arrangement of the handle member 31 of the present invention, the cargo loading operator walking along the central walkway 11 can open each door 7, 19 with one hand by simply grabbing the handle member 31 and lifting the door while standing at the central walkway 11. Since the cargo loading operator is on the center walkway 11, he is on a generally planar surface and is not directly positioned over the opening. This provides for a safer and more efficient way of opening the doors 7 or 19 of the cover assembly of the present invention.

In an embodiment of the present invention, the handle members 31 can include a locking or latch assembly 33 as illustrated in FIGS. 9 and 10 in which a pivotable member 35 attached to the handle member 31 can cooperate with a member 37 on the body of the cover assembly 1, to achieve a locking condition as illustrated in FIG. 10. This is one embodiment of a locking assembly which can be used within the context of the present invention, and further types of locking assemblies can be utilized provided that the locking assemblies work in conjunction with the elongated handle member 31 of the present invention. That is, the locking assembly should be of the type which permits an unlocking upon an upward movement of the handle member 31 by the cargo loading operator as he passes along the central walkway 11.

The doors 7 and 19 of the present invention can flier include raised portions or cradles with integral bumpers 39 as illustrated in FIGS. 6 and 7. FIG. 6 illustrates a position in which either of the doors 7 and 19 is in a closed position. Upon opening by lifting the handle member 31 to open the door, the raised portions 39 which are spaced on the door opposite the hinges abut against a corresponding rib 23. With the arrangement of the raised portions 39 abutting against the ribs 23 upon the opening of the doors 7 or 19, any bending of the door will be minimized.

Therefore, the present invention provides for a lift-off cover assembly for barges which includes bigger walkways and conveniently positioned climbing stairs. The cover assembly of the present invention further provides for doors and openings which include handles and/or latches which permit the opening of the doors from a central walkway on the barge cover assembly. Additionally, the ribs on the barge cover assembly extend toward the edge of the cover assembly and define open spaces which do not trap water. Furthermore, the structure of the barge cover assembly of the present invention provides for an increased cargo area with wider openings.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A cover assembly for a barge comprising:

at least one curved cover section having a width which extends over a width of a barge;

a first opening located on a first side of a central longitudinal axis of said at least one curved cover section;

a second opening located on a second side of the central longitudinal axis of said at least one curved cover section;

a first cover member for closing said first opening;

a second cover member for closing said second opening;

the said cover assembly further comprising a plurality of said curved cover sections which may be positioned adjacent to each other; and first and second curved end cover sections positioned on opposite ends of said curved cover sections which may be adjacently positioned, wherein said central longitudinal axis extends through said curved cover sections and said first and second curved end cover sections;

wherein each of said first and second curved end cover sections comprises end section openings positioned on each side of the central longitudinal axis and end section cover members for closing said end section openings, wherein each of said end section cover members comprise end section handle members associated with said end section cover members for moving said end section cover members between at least a closed position in which the associated end section opening is closed and an open position in which the associated end section opening is opened, and wherein each of said first and second cover members and said end section cover members comprise integral raised portions, such that in the opened position of said first and second cover members and said end section cover members, said raised portions abutt against said ribs.

2. A cover assembly according to claim 1, further comprising:

a first handle member associated with said first cover member for moving the first cover member between at least a closed position in which said first opening is closed and an opened position in which said first opening is opened, said first handle member extending toward the central longitudinal axis of said at least one curved cover section; and a second handle member associated with said second cover member for moving the second cover member between at least a closed position in which the second opening is closed and an open position in which the second opening is opened, said second handle member extending toward the central longitudinal axis of said at least one curved cover section.

3. A cover assembly according to claim 2, further comprising a central walkway which extends along the central longitudinal axis of said at least one curved cover section and between the first and second openings, wherein said first and second handle members are accessible from said central walkway so as to permit an opening and closing of said first and second cover members from said central walkway.

4. A cover assembly according to claim 3, wherein said central walkway comprises a non-skid surface.

5. A cover assembly according to claim 3, further comprising:

first climbing stairs located on the second side of said at least one curved cover section and extending from an edge of said at least one curved cover section at the second side toward the central longitudinal axis, said first climbing stairs and said first opening being positioned substantially within a same first vertical plane; and second climbing stairs located on the first side of said at least one curved cover section and extending from an edge of said first side toward the central longitudinal axis, said second climbing stairs and said second opening being located substantially within a same second vertical plane.

6. A cover assembly according to claim 5, wherein said first and second climbing stairs extend in a direction substantially perpendicular to said central longitudinal axis.

7. A cover assembly according to claim 5, wherein said first and second climbing stairs comprise non-skid surfaces.

8. A cover assembly according to claim 5, wherein said first and second climbing stairs respectively define first and second paths which lead to said central walkway.

9. A cover assembly according to claim 1, wherein each of said first and second curved end cover sections comprise end section climbing stairs which extend along the central longitudinal axis to an area between the end section openings.

10. A cover assembly according to claim 1, wherein each of said plurality of curved cover sections and said first and second curved end cover sections are made of a fiberglass material.

11. A cover assembly according to claim 1, further comprising a locking assembly associated with each of said first and second cover members and said end section cover members for locking each of said first and second cover members and said end section cover members in the closed position.

12. A cover assembly for a barge comprising:

a plurality of adjacently positioned curved cover sections;

first and second end cover sections positioned on opposite end of said adjacently positioned curved cover sections to define a cover assembly which is adapted to fit on a barge so as to define a storage space thereunder;

a plurality of openings positioned on each side of a central longitudinal axis which extends along said adjacently positioned curved cover sections and said first and second end cover sections;

lids associated with each of said openings which cover each of said openings in a closed position of said doors;

a central path extending along the central longitudinal axis, and a handle on each of said lids which permits a movement of each of said lids from the closed position to an opened position to permit access to the storage space through said openings, wherein each of the handles extend to a vicinity of said central path so as to permit a lifting up of each of the handles from the central path and thereby permit an opening of each of said lids from said central path, and wherein each of said first and second end cover sections comprises end ribs which extend in a direction of said longitudinal axis and define open spaces.

13. A cover assembly according to claim 12, wherein each of said curved cover sections and said first and second end cover sections comprise ribs which define a plurality of spaces for permitting water drainage.

14. A cover assembly according to claim 12, further comprising:

a plurality of first walking stairs which extend in a direction perpendicular to said central longitudinal axis and lead toward an associated one of each of said openings; and second walking stairs on each of said first and second end cover sections which extend in a direction of the central axis.

* * * * *